US005152164A

United States Patent [19]

Horiuchi et al.

[11] Patent Number: 5,152,164

[45] Date of Patent: Oct. 6, 1992

[54] APPARATUS FOR ADJUSTING WIDTH OF ROLL FOR ROLLING MILL

[75] Inventors: Yasushi Horiuchi; Takashi Yamamuro, both of Sakai; Takashi Haji, Kitakyushu; Kenji Uezono, Kitakyushu, all of Japan

[73] Assignee: Nippon Steel Corporation, Tokyo, Japan

[21] Appl. No.: 728,567

[22] Filed: Jul. 11, 1991

[51] Int. Cl.[5] ..... B21B 31/18

[52] U.S. Cl. ..... 72/224; 72/238; 72/247; 29/125

[58] Field of Search ..... 72/225, 247, 238, 199, 72/224, 249; 29/124, 125

[56] References Cited

U.S. PATENT DOCUMENTS 4,685,319 8/1987 Aoyaqi et al. ..... 72/234
5,031,435 7/1991 Seto et al. ..... 72/247

FOREIGN PATENT DOCUMENTS 0017310 1/1986 Japan ..... 72/247
0156007 7/1987 Japan ..... 72/247
62-176604 8/1987 Japan .
1-33243 7/1989 Japan .
0284717 11/1990 Japan ..... 72/247

*Primary Examiner*—Lowell A. Larson
*Assistant Examiner*—Thomas C. Schoeffler
*Attorney, Agent, or Firm*—Kenyon & Kenyon

[57] ABSTRACT

A roll for a rolling mill capable of an on-line control of the width thereof. The roll includes a drive roll connected to a mill motor and a hollow driven roll driven by the drive roll while being axially slidable with respect to the drive roll. A screw shaft is screwed to the inside of the hollow driven roll in such a manner that an end-to-end contact of the driven roll with the drive roll is obtained. A clutch is provided for a selective locking of the screw shaft, which is unlocked during a normal rolling process, so that the screw shaft is rotated together with the drive roll and the driven roll by a rotation of the mill motor. When adjusting the roll width, the clutch is operated so that the screw shaft is locked, and as a result, a rotation of the mill motor causes a mutual axial movement of the drive roll and driven roll to thus adjust the roll width. A means is also provided for a centering of the roll at the pass line of the material, after the adjustment of the roll width.

10 Claims, 8 Drawing Sheets

APPARATUS FOR ADJUSTING WIDTH OF ROLL FOR ROLLING MILL

BACKGROUND OF THE INVENTION

1. Field of the Invention

The present invention relates to a rolling mill, and more particularly to an apparatus for adjusting a desired width of a horizontal roll for a rolling mill to thereby obtain a steel product having a desired shape, such as an H beam, without dismantling the roll from the roll stand thereof.

2. Description of the Related Art

Known in a prior art is a universal rolling mill which includes a horizontal roll having a width which can be varied to obtain a desired dimension of an H beam. Various methods of adjusting a width of the roll, with or without dismantling the roll from the roll stand, have been proposed. Japanese Examined Patent Publication (Kokoku) No. 1-33243, for example, discloses hollow rolls having, at the ends thereof, screw threads to which respective thrust rings are screwed, and a roll shaft is axially and slidably inserted through the thrust rings and hollow rolls. The hollows rolls have flange shaped rolling portions axially spaced from each other; the rolling portions thereof coming into contact with a material to be rolled. Clutch members, which are usually disconnected, are provided for a selective connection of adjusting gears with respective thrust rings, when an adjustment of the effective width of the roll is desired. The rotation of the adjusting gears by suitable actuators causes a mutual rotating movement to be generated between the thrust rings and the hollow rolls, which causes a distance between the rolling portions (the effective width of the roller) to be varied. This prior art suffers, however, from a drawback in that no provision is made for a prevention of a mutual rotation between the rolls and the thrust rings when a usual material rolling operation is carried out, and therefore, the effective width of the rolls may be accidentally varied. An arrangement of thrust rings at the axial ends of elongated hollow rolls causes a rolling reaction force to be transmitted to the thrust rings via the lengthy hollow rolls, which force is generated in end surfaces of the rolling portions when the material is subjected to a rolling process, resulting in an increased variation of a distance between the remote ends of the rolling portions and causing the precision of the dimension of an inner web of the rolled product to be worsened. Furthermore, there is also a drawback in that a process for obtaining a centering of the roll with respect to a pass line is complicated.

As technique which can overcome the above-mentioned drawback, the assignee of the inventor of the present invention has proposed an apparatus for adjusting a width of a roll without dismantling the roll from the roll stand (housing), in Japanese Unexamined Patent Publication (Kokai) No. 62-176604. The apparatus in this prior art is provided with a shaft having an outer screw thread portion formed thereon, and an axially spaced apart horizontal fixed roll and horizontal movable roll, which are axially slidably inserted to each other, are arranged over the screw thread portion. The horizontal movable roll is provided with a roll width adjustment screw which is in screw engagement with the outer screw thread portion, and a rotating means such as a gear is provided for rotating the roll width adjustment screw to thereby adjust the axial movement of the movable roll with respect to the fixed roll, whereby a desired effective width of the roll is obtained. This improved apparatus suffers from a drawback in that the adjustment of the roll width in the direction of reducing the width is difficult, since a sleeve member for controlling the width of the roll is located between the rolls and may come into contact with the rolls when they are adjusted to reduce the distance therebetween. Furthermore, this prior art suffers from a drawback in that a large drive force is required to obtain a quick adjustment of the roller width, which inevitably increases the dimension of the apparatus and prevents it from being housed in the rolling mill housing as is. To avoid this difficulty, it has been proposed to provide a drive source in the stand housing, but this makes the replacement of the rolls complicated and time-consuming.

SUMMARY OF THE INVENTION

An object of the present invention is to provide an apparatus for controlling the width of a roll without dismantling the roll therefrom, to thus overcome the above-mentioned drawbacks of the prior arts.

Another object of the present invention is to provide an apparatus for controlling the width of a roll by using a mill motor for an adjustment of the roll width, without the need to use a separate drive for the adjustment.

Further, another object of the present invention is to provide an apparatus for controlling the width of a roll, by which a quick adjustment of the width of a roll is obtained.

Still another object of the present invention is to provide an apparatus for controlling the width of roll, by which not only the size but also the cost thereof is reduced.

According to the present invention there is provided an adjustable roll apparatus for a rolling mill, comprising:

a roll having an axis for rotation, which includes a first roll member and second roll member having portions for engaging a material to be rolled;

first bearing means for supporting the first roll member for rotation about said axis;

second bearing means for supporting the second roll member for rotation about said axis;

drive means connected to the first roll member for obtaining a rotation of the first roll member;

the first roll member having a reduced diameter connection portion extending axially;

the second roll member having a first bore extending axially and to which said connection portion is inserted;

coupling means provided between said connection portion and the bore for connecting the first and second rolls with each other such that they can be rotated by the drive means, the first and second rolls being axially slidable relative to each other;

a screw shaft extending axially and inserted into the second roll so that the screw shaft axially engages with said connection portion of the first shaft therewith;

said second roll having an axially extending screw bore to which said screw shaft is screw engaged;

said screw shaft being usually free and able to be rotated together with the first and second rolls, to allow the rolling process to be carried out; and clutch means for selectively locking said screw shaft so that the screw shaft is locked to obtain an axial mutual movement between the first and second rolls upon the rotation of the first roll, to thereby adjust the axial spacing between the first and second rolls.

According to the present invention, a rotation of the mill motor is also used for obtaining the adjustment of the width of the roll, thus eliminating the need for a separate motor means for obtaining the adjustment. A strong force from the mill motor can be used for controlling the roll width, to thus enable a rapid adjustment. A quick "on-line" adjustment can be made by which the roll width can be quickly changed between passes in which materials to be rolled are processed. Furthermore, the construction for the adjustment of the width of roll is simplified, which allows an existing roll stand to be used as is. Also, the precision of the adjustment is increased, and the time needed to complete the adjustment is shortened.

BRIEF DESCRIPTION OF ATTACHED DRAWINGS

Figure 1:
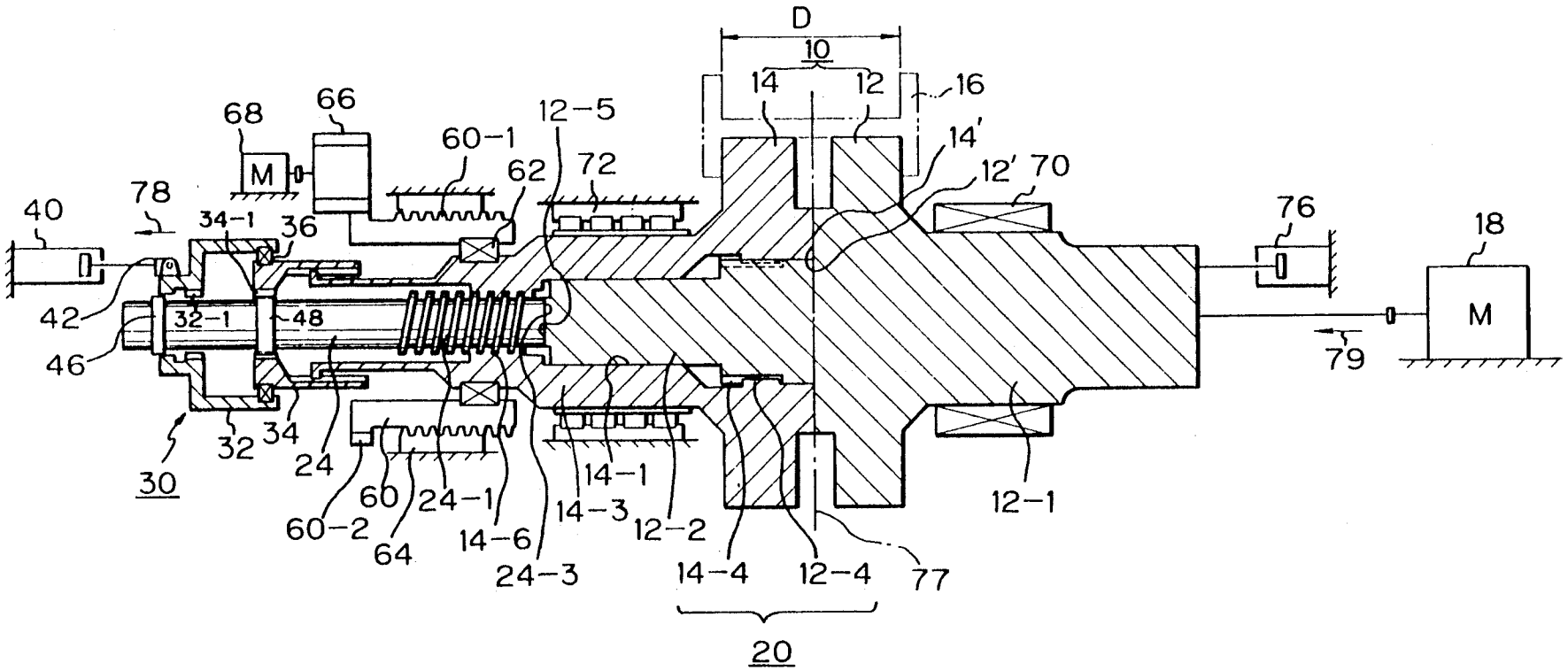
FIG. 1 is a longitudinal cross sectional view of a roll for a rolling mill according to the present invention.
Figure 4:
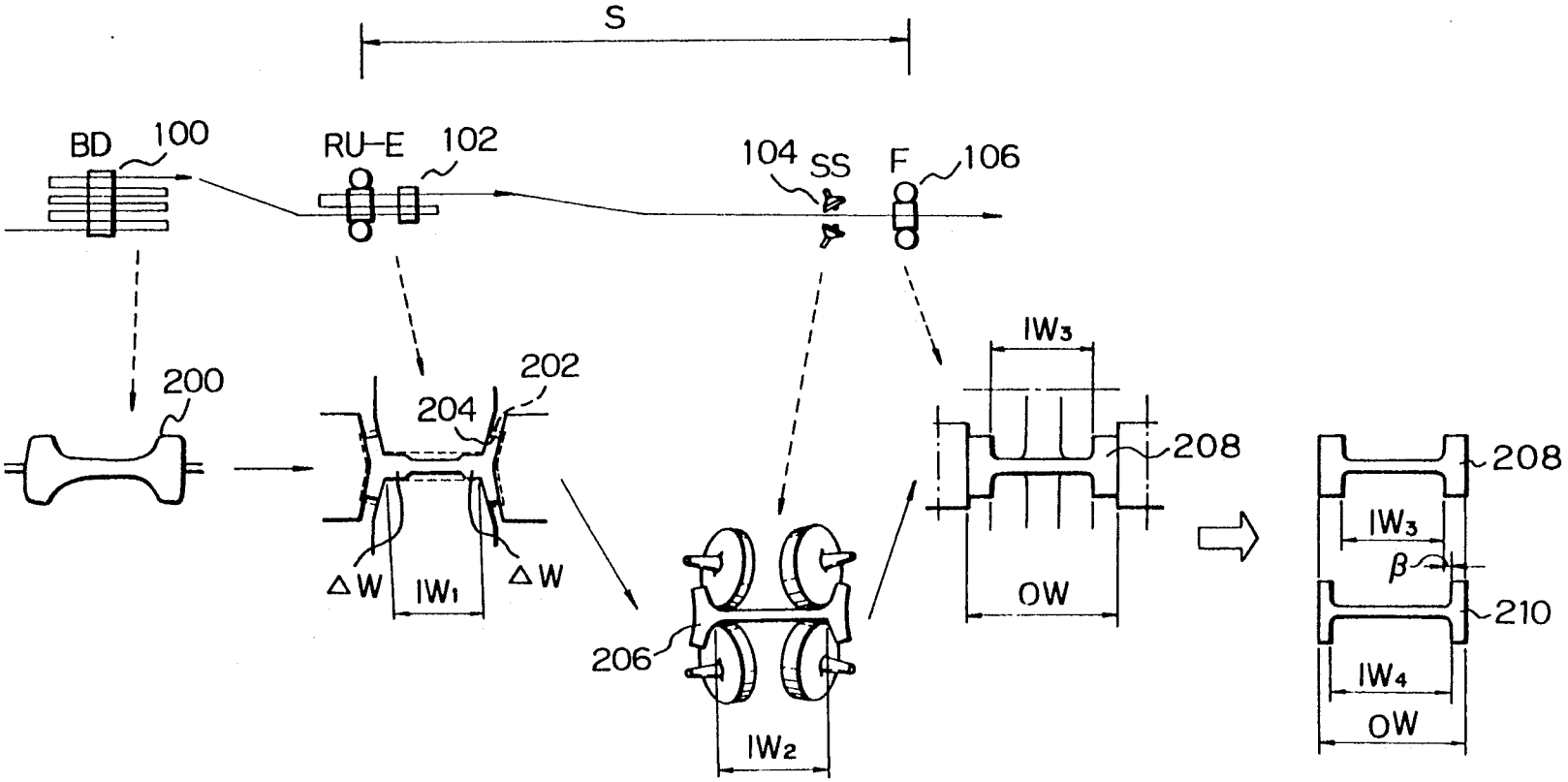
Figure 5:
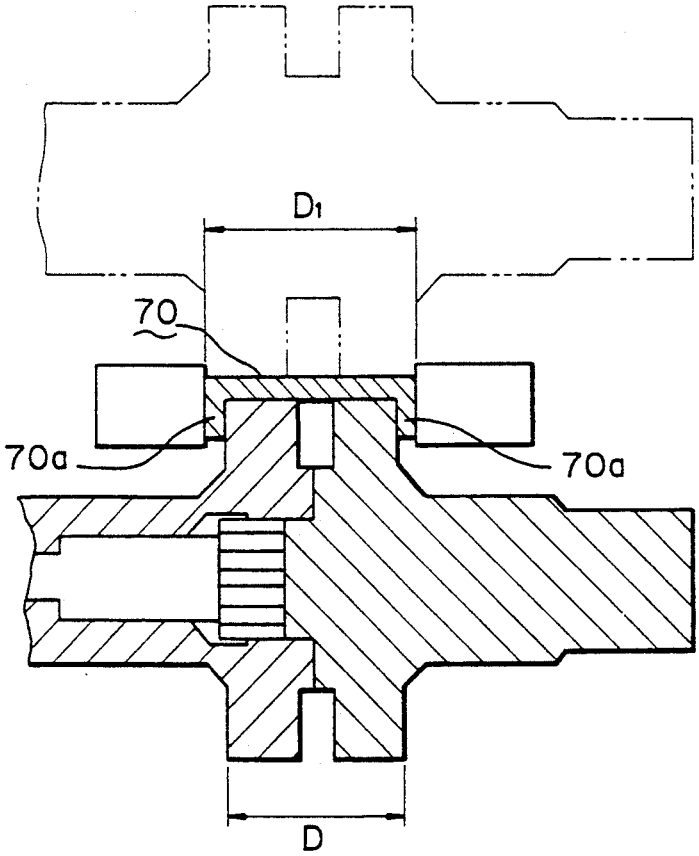

FIG. 3(*a*) to (*d*) are similar to FIG. 1, but show sequentially how the control of the adjustment of the width of a roll is carried out;

FIG. 4 schematically illustrates an arrangement of a series of rolling mills for obtaining an H beam, wherein the finishing rolling mill is provided with an apparatus for controlling the width of a roll according to the present invention;

FIG. 5 shows a construction of rolls for obtaining a channel steel using an apparatus for controlling the width of the rolls according to the present invention.

DESCRIPTION OF THE PREFERRED EMBODIMENTS

FIG. 1 shows a horizontal roll 10 in an universal type rolling mill for the production of an H beam, which roll 10 is comprised by two horizontally arranged separate roll members; a drive roll member 12 and a driven roll member 14. As will be fully described later, the apparatus shown in FIG. 1 is able to adjust a distance D between the axially spaced apart ends of the rolls 12 and 14, corresponding to an inner web distance of an H beam 16 as produced, without dismantling the rolls from a roll stand thereof. It should be noted that a pair of such horizontal rolls 10, which are vertically spaced, are used and a material to be rolled is passed between these rolls. Note, these two rolls have the same construction, and therefore, only one roll, i.e., that located on the lower side, will be illustrated, to simplify the explanation.

As shown in FIG. 1, the horizontal drive roll member 12 has an axially extending neck portion 12-1 which is connected to and driven by a mill motor 18, to impart a rotating movement of the roll member 12 about the axis thereof to thereby execute the rolling process, and a connecting shaft portion 12-2 extending along the axis of the roll integrally from the neck portion 12-1. The driven roll 14 has an axially extending bore 14-1 formed therethrough in which the connection shaft portion 12-2 of the driving roll 12 is located. The driven roll 14 has an axially extending neck portion 14-3. The drive roll member 12 and driven roll member 14 are connected to each other by a spline coupling 20 which allows the roll members 12 and 14 to be axially slidable relative to each other while the rotating movement is transmitted to the driven roll member 14 from the drive roll member 12. The spline coupling 20 is constructed by an outer spline portion 12-4 of the connection shaft portion 12-2 of the drive shaft 12 and an inner spline portion 14-4 on the end of the bore 14-1 of the driven roll 14.

As shown in FIG. 1, a screw shaft 24 is axially inserted to the neck portion 14-3 of the hollow driven roll 14 so that the end surface 12-5 of the connection portion 12-2 of the drive roll 12 abuts against the end face surface 24-3 of the screw shaft 24 and the screw shaft 24 has an outer screw thread portion 24-1 which is engaged with an inner screw portion 14-6 formed in the shaft portion 14-3 of the driven roll member 14.

Figure 2:
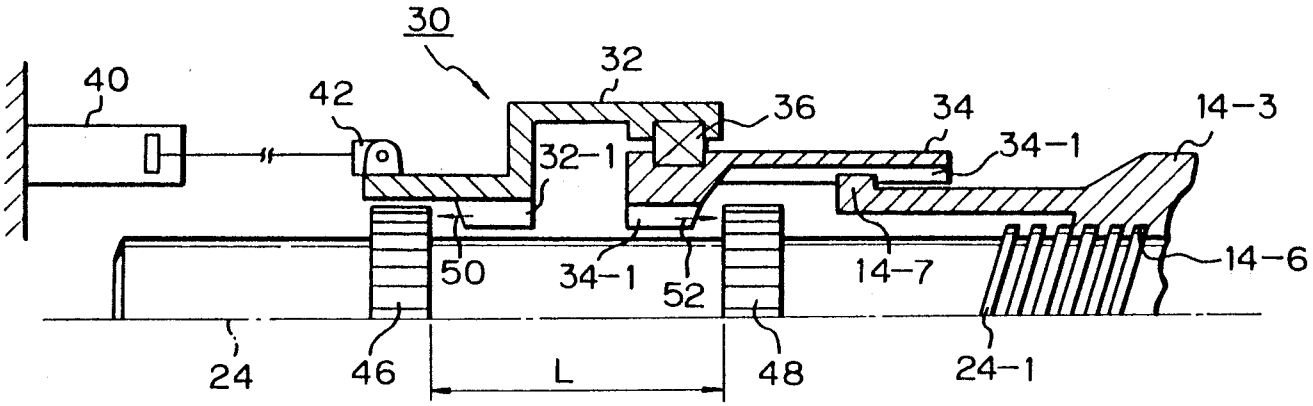
FIG. 2 is an enlarged view of a part of FIG. 1, illustrating how a clutch device is constructed.

A clutch device 30 is provided for selectively preventing a rotation of the screw shaft 24 about its axis, which allows the driven roll 14 to be locked whereby the drive roller 12 can be moved axially with respect to the driven roller 14 upon the rotation of the latter, due to the spline connection therebetween by the spline coupling 20, and thus the distance D can be adjusted, as will be fully described later. The clutch 30 is provided with a clutch housing 32 and an intermediate sleeve 34 which are rotatable relative to each other through a roller bearing 36 i.e., the housing 32 and sleeve 34 are thus rotatable relative to each other while both the housing 32 and sleeve 34 are axially moved in unison. As shown in FIG. 2, the sleeve member 34 is provided with axially extending inner grooves 34-1 with which radial projections 14-7 on the end of the neck portion 14-3 of the hollow driven roll 14 are engaged, which allows the clutch sleeve 34 and driven roll 14 to be rotated relative to each other while able to relatively slide in the axial direction when a clutch operation is carried out to adjust the width D, as will be fully described later. The clutch 30 is further provided with an actuator 40 such as a fluid cylinder, which is connected to the clutch housing 32 via a coupling 42 for axially and reciprocally moving the clutch housing 32. The clutch housing 32 is provided with an inner first clutch portion 32-1, and the sleeve member 34 is provided with an inner second clutch portion 34-1. Axially spaced apart first and second gears 46 and 48 are integrally formed on the screw shaft 24 at a distance L. FIG. 2 shows an intermediate position whereat both the first and second gears 46 and 48 are disengaged from the respective clutch portions 32-1 and 34-1, respectively. When the clutch housing 32 is moved to the left to a predetermined position, as shown by an arrow 50 in FIG. 2, the clutch portion 32-1 of the clutch housing 32 is engaged with the first gear member 46 on the screw shaft 24, to lock the screw shaft 24 and thereby allow the rolling distance D to be adjusted. When the clutch housing 32 is moved to the right to a predetermined position, as shown by an arrow 52 in FIG. 2, the clutch portion 34-1 is engaged with the second gear member 40 on the shaft 24 to thereby cause the screw shaft 24 to be rotated together with the roll members 12 and 14 and thus allow the material to be rolled between the vertically faced rolls 10. In FIG. 1, the clutch 30 is shown in the unlocked position, i.e., the gear 48 is engaged with the clutch portion 34-1 of the intermediate sleeve 34, which allows the screw shaft 24 to be rotated together with the rotation of the rolls 10 and 12 by the motor 18, to thereby carry out a rolling operation.

The apparatus according to the present invention is further provided with means for obtaining a desired centering of the rolls with respect to the center 77 of a pass line of the material to be processed. Namely, a centering sleeve 60 is arranged coaxially with respect to the shaft of the apparatus, and is connected to the hollow shaft portion 14-3 of the driven roll 14 via a roller bearing 62, so that they are rotatable with each other while axially movable in unison. The centering sleeve 60 forms an outer screw portion 60-1 which is engaged with an annular nut member 64 fixed to a housing. The centering sleeve 60 forms a gear portion 60-2, which is engaged with a pinion 66 connected to a motor 68, to thus impart a rotating movement to the centering sleeve 60 via the pinion 66.

Reference numeral 70 is a bearing for supporting the neck portion 12-1 of the drive roll 12 at a not shown stand housing via a not shown chock, to adjust the level of the roll. Another bearing unit 72 is provided for supporting the neck portion 14-3 of the driven roll 14 of the stand housing (not shown), which allows the neck portion 14-3 of the driven roll 14 to be axially movable.

Finally, a second actuator 76 such as a fluid cylinder is connected to the end of the neck portion 12-1 of the drive roll 12, and generates a fluid force in the drive roll 12 to urge it toward the driven roll 14 along the axial direction, as shown by an arrow 79, to thereby eliminate a possible clearance between the outer screw thread 24-1 on the screw shaft 24 and the inner screw thread 14-6 on the neck portion 14-3 of the driven roll 14 (FIG. 2). Regarding the actuator 40 or 76, the fluid cylinder may be replaced with any equivalent means such as a screw mechanism.

The operation of the present invention for adjusting the effective width D of the roll will now be explained.

In FIG. 1, the width D has a minimum value at which the rolling members 12 and 14 are in contact with each other at the facing end surfaces 12, and 14, thereof located along a center pass line 77. Before commencing the adjustment, the mill motor 18 for rotating the roll 10 is de-energized, to stop the rotation of the roll 10, and a not shown fluid pressure controller of the actuator 76 is operated to reduce a force applied therefrom to the roller 12, as shown by the arrow 79. Then, the first actuator 40 is operated so that the clutch housing 32 of the clutch 30 is moved in a direction 78. As shown in FIG. 3(*a*), this movement allows the gear portion 48 to be disengaged from the clutch portion 34-1 of the sleeve 34, and the gear member 46 on the screw shaft 24 to be engaged with the clutch portion 32-1 of the clutch housing 32 as a fixed member, and as a result, the screw shaft 24 is locked to the clutch housing 32, and thus the driven roll 14 is rotatable about the screw shaft 24. The condition of the clutch device 30 as shown in FIG. 3(*a*), where the gear portion 36 is engaged with the first clutch portion 32-1, is referred to as the locked position.

The mill motor 18 is then rotated in a forward direction, as shown by an arrow 90, and this rotation is transmitted to the rollers 12 and 14, which causes the screw shaft 24 to be moved to the right due to the left hand screw engagement of the screw thread 24-1 of the screw shaft 24 with the screw thread 14-6 of the hollow shaft portion 14-3 of the driven roll 14, causing the drive roll 12 to be moved in the same direction due to the axially slidable engagement of the driven roll 14 with the drive roll 12 via the coupling 20. During this movement of the screw shaft 24, the gear member 46 remains engaged with the first clutch portion 32-1, and after a predetermined value of the distance D=D1 is obtained, as shown by FIG. 3(*b*), the rotation of the mill motor 18 is stopped. Note, at this position shown in FIG. 3(*b*), the roll 10 is off-center from the center line 77 of the rolling pass.

To center the roll 10 at the adjusted width D=D1, the motor 68 is rotated, and thus the sleeve 60 is rotated via the gear 66, causing the sleeve 60 to be axially moved due to a screw engagement thereof with the nut 64 fixed to the stand housing. As a result of the axial movement of the sleeve 60, the driven roll 14 and drive roll 12, together with the screw 24, are moved to the left in FIG. 3(*b*) through the bearing 72, which allows an axial sliding movement of the driven roll 14, whereby a centering position as shown in FIG. 3(*c*) is obtained at which the roll 10 is centered with regard to the rolling pass 77.

Figure 3A:
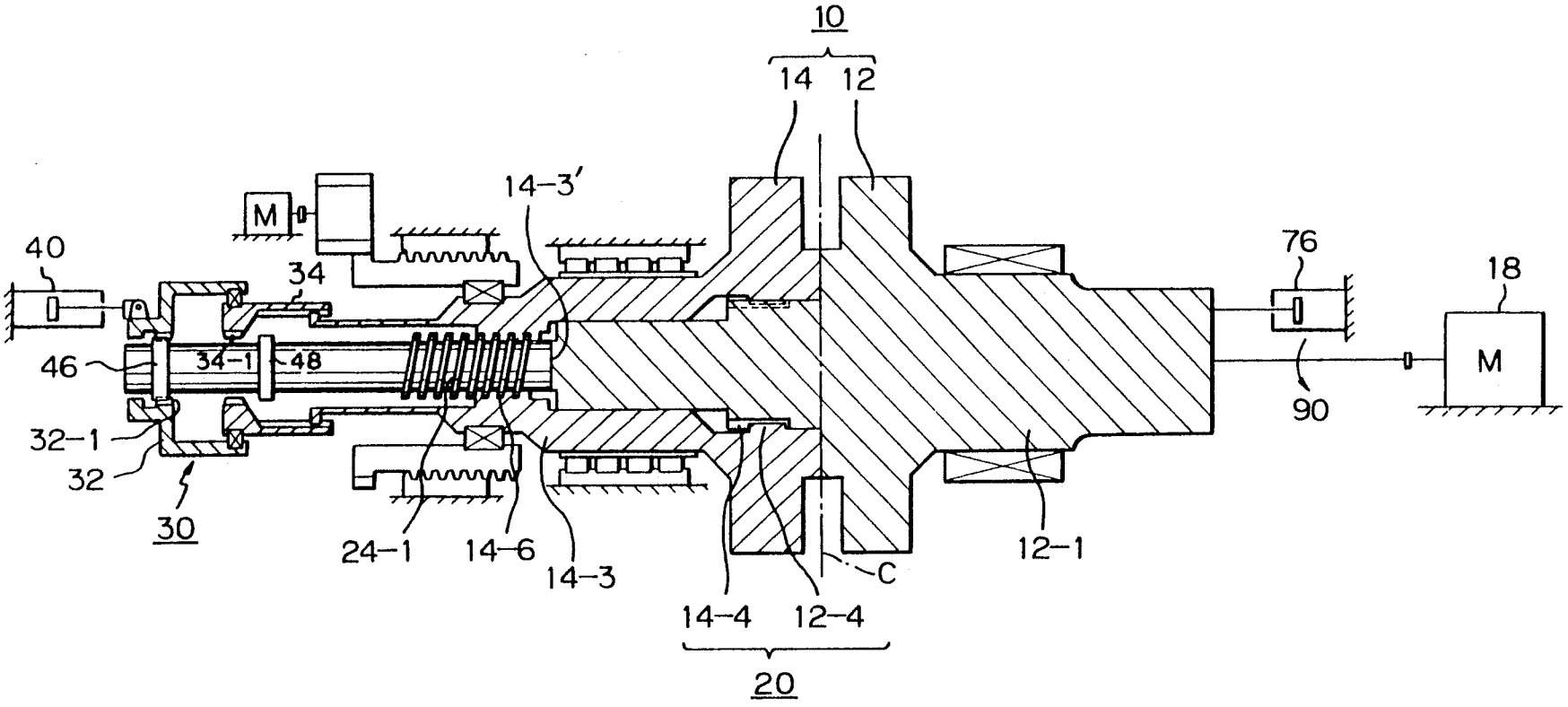
Figure 3B:
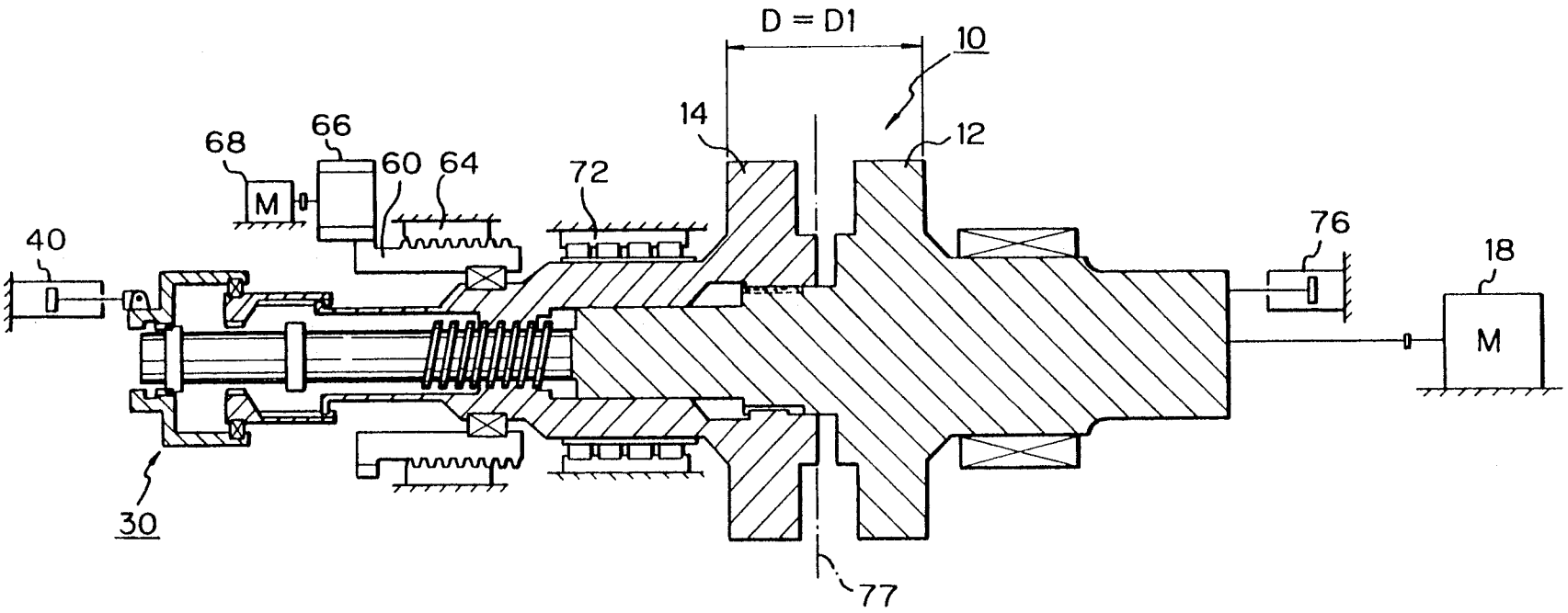
Figure 3C:
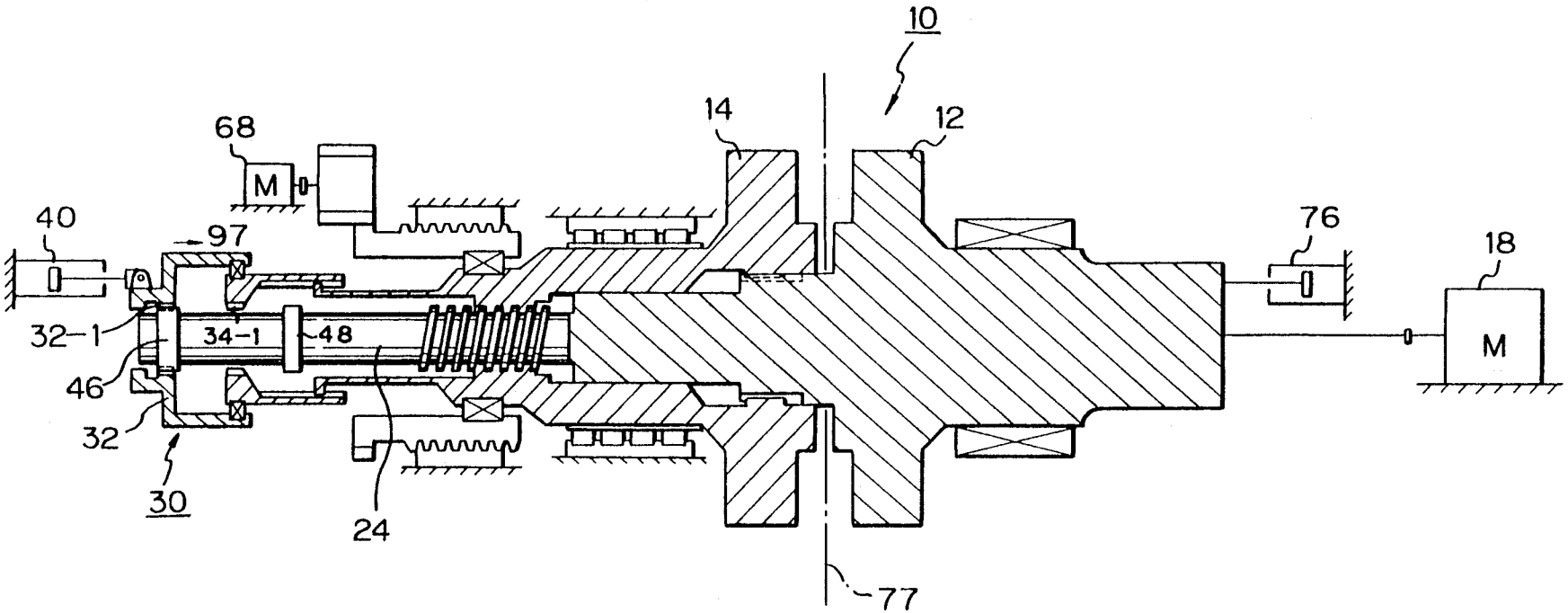
Figure 3D:
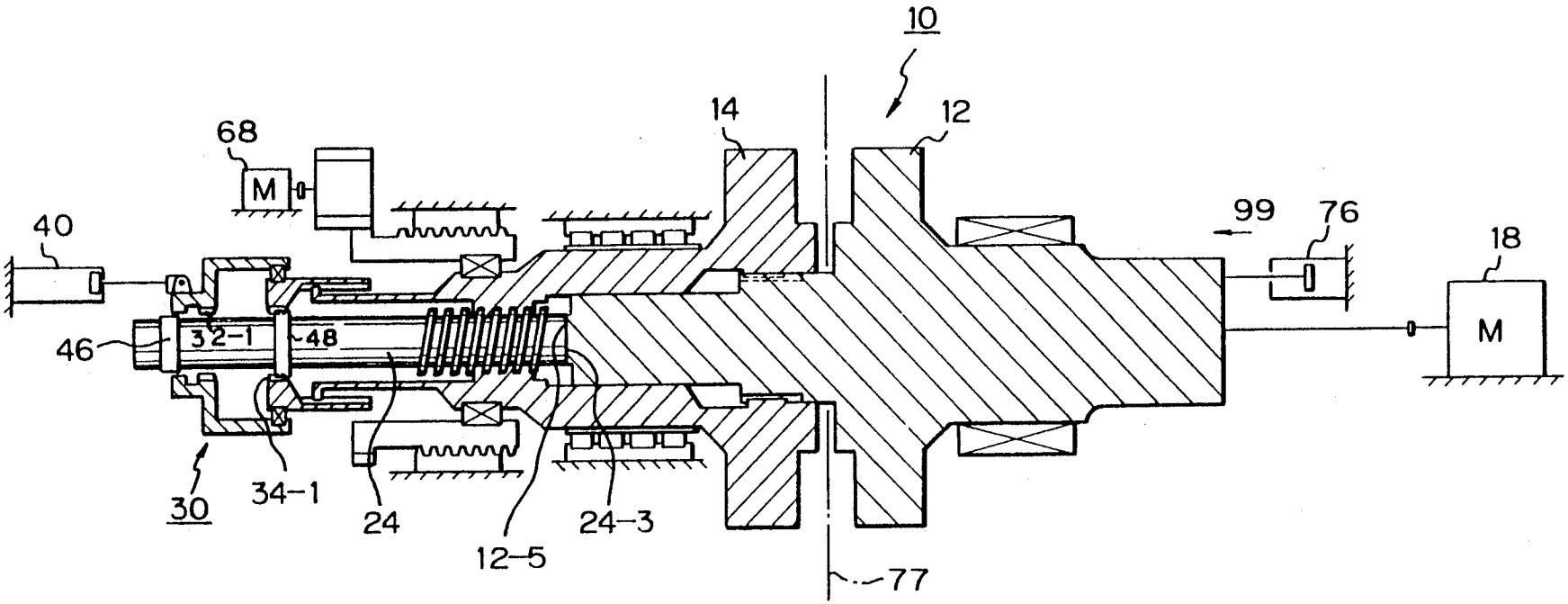

After the adjustment of the roll width and centering are thus completed, the actuator 40 is energized so that the clutch housing 32 is moved to the right as shown by an arrow 97 in FIG. 3(*c*), which causes the clutch portion 32-1 to be disengaged from the gear portion 46, and clutch portion 34-1 to be engaged with the gear member 48 on the screw 24 as shown in FIG. 3(d). As a result of the engagement of the clutch 30, the screw shaft 24 is unlocked and can be rotated integrally with the rolls 12 and 14. Finally the actuator 76 is energized to generate an axial force at the drive roll 12 in the direction of an arrow 99 whereby the drive roll 12 and screw shaft 24 are brought into contact at the end face surfaces 12-5 and 24-3 thereof, to thus eliminate any clearance between the outer screw portion 24-1 of the screw shaft 24 and the inner screw portion 14-6 of the driven roll 14. As will be easily understood from the foregoing explanation, with the present invention a desired effective width of the roll 10 can be obtained without dismantling it from the roll stand. To reduce the width of the roll, the process explained above is reversed. Namely, the motor 18 is rotated in a direction opposite to the direction 90 in FIG. 3(*a*), so that the drive roll 12 is moved toward the driven roll 14 until a desired roll width D is obtained. Then the motor 68 is rotated to center the roll 10.

As will be understood from the above description, the embodiment as illustrated is provided with a centering mechanism for centering the roll 10 with the center of a pass line, but the centering mechanism can be omitted if an appropriate billet guide means is provided.

FIG. 4 is a schematic overall view of a series of rolling mills for obtaining an H-beam wherein a constant width OW of the outer web of the H-beam is required. An example of this kind of rolling mill is disclosed in U.S. Pat. No. 4,685,319, owned by the assignee of this invention. In FIG. 4, reference numeral 100 denotes a break down mill (BD), 102 an intermediate mill comprised by a universal mill (RU) and edger mill (E), 104 an inclined roll type sizing mill (SS), and 106 a finishing rolling mill (F) provided with the apparatus for adjusting the effective rolling width according to the present invention, as described with reference to FIG. 4.

The material to be rolled is a roughly shaped slab or section and is subjected to a reverse rolling by the break down mill 100, to obtain a roughly shaped section material 200. At the intermediate rolling mill 102, via a intermediate cross sectional shape as shown by dotted line 202, in consideration of the inner web width IW3 and IW4 to be finally produced, a section having the cross-sectional shape 204 is obtained and has projections having a thickness of $\Delta W$ on both sides of a web in the direction of the height thereof, which are used for increasing the width in the direction of the height of the web, as will described later. The cross sectional shape 204 is not limited to that as shown, and the thickness of the web and flange can be changed in accordance with function of the universal rolling mill, and further, any desired number of different cross sectional shapes covering a series of products can be obtained. Note, in this intermediate rolling stage, although the web has a constant inner width IW1, the outer web width is not necessarily constant.

The intermediate material having the cross sectional shape 204 is processed by the inclined roll type sizing mill 104 to obtain a billet 206, which is rolled to a web having an inner width IW3 which corresponds to a product to be obtained in the series. A detailed explanation of the sizing mill 104 is omitted, and the increase in the width is controlled by three parameters, i.e., the angle of the inclined rolls, a spacing between the rolls along the width, and the amount of depression of a web, which are "on-line" controlled in a well known manner.

The material 206 as produced in the sizing rolling mill 104 is processed by the universal rolling mill 106 to obtain a final product having a desired inner width IW and a constant outer web width OW, as shown by the shape 208 having a width IW3. The shape 210 is an alternative to a shape of the final product having a web thickness IW4, to reduce a value of $\beta$ with respect to the shape 208 while maintaining the same outer width WO.

The roll width control apparatus according to the present invention, when applied to the finishing mill 106 in a series of universal rolling mills, obtains the following effect.

A combination thereof with the inclined roll type sizing mill makes it possible to select, in an "on-line" manner, a desired type of H beam having a constant outer width, without changing the arrangement of the rolls.

The employment of a mill motor for adjusting the width makes its possible to obtain a large rotating torque, by which the speed of changing the width is increased.

The high speed adjustment of the roll width allows the spacing between the rolling mills to be shortened, whereby the layout of the mills is simplified. It is well known to those skilled in this art that the spacing S between the intermediate rolling mill 102 and the universal rolling mill 104 is generally longer than the maximum elongation of the material subjected to the reverse rolling by the intermediate rolling mill 102. The employment of the width adjustment apparatus according to the present invention for the finishing mill 106 makes it possible to provide a spacing S shorter than the maximum length of the elongation of the material subjected to the intermediate rolling, since an adjustment of the roll width can be rapidly made, and therefore, the movement of the material subjected to the intermediate rolling is not blocked by the finishing rolling mill 106. Note, the material in this case passes through the finishing mill without being rolled, and the material is reintroduced into the finishing mill to obtain a final product.

The above embodiment is directed to an application thereof to a universal finishing rolling mill for obtaining an H beam, but the present invention also can be applied to a section other than an H beam. For example, the present invention can be applied to a universal finishing mill for obtaining a channel steel section as shown in FIG. 5. In this case, the distance D between the lower horizontal rolls is controlled, and therefore, it becomes possible to accommodate the various flange thicknesses of the flange 70*a* of the channel steel 70, and thus a shaping and finish milling of various thickness of the same height of web D1 can be carried out by the same pair of vertically spaced rolls. The upper horizontal roll in the embodiment in FIG. 5 may be the roll for which the width is adjusted in accordance with the present invention, or it can be a conventional integral type.

Although the present invention is described with reference to attached drawings, many modifications and changes can be made by those skilled in this art without departing from the scope and spirit of the present invention.

We claim:

1. A rolling mill comprising:

a set of adjustable rolls between which a material to be rolled is passed; and a mill motor for causing rotation of said rolls for carrying out a rolling operation on the material;

each of said adjustable rolls comprising:

first and second roll members having axes for rotation, and having respective portions for engaging the material to be rolled;

first and second bearing means for supporting the first and second roll members, respectively, for rotation about the respective axes;

said mill motor being connected to the first roll member for causing rotation of the first roll member;

the first roll member having a reduced diameter connection portion extending axially;

the second roll member having a first bore extending axially into which said connection portion of the first roll member is inserted;

coupling means provided between said connection portion and the first bore for connecting the first and second rolls with each other such that said first and second roll members are rotated by the mill motor while being axially slidable relative to each other;

a screw shaft extending axially and inserted into the second roll member so that the screw shaft axially engages with said connection portion of the first roll member;

said second roll member having an axially extending screw bore, said screw shaft being screw engaged with said screw bore;

said screw shaft normally being free and able to be rotated together with the first and the second roll members, to allow the rolling process to be carried out by the rotation of the mill motor; and clutch means for selectively locking said screw shaft so that the screw shaft is locked to obtain an axial mutual movement between the first and second roll members upon the rotation of the first roll member, to thereby adjust the axial spacing between the first and second roll members merely by rotating the mill motor without provision of a special, separate rotating means for adjusting roller width.

2. An apparatus according to claim 1, wherein said clutch means comprise an actuator for obtaining an axial direction movement, and a clutch operated by the actuator between a first position at which the screw shaft is freed from the clutch shaft and a second position at which the screw shaft is locked.

3. An apparatus according to claim 2, wherein said screw shaft has axially spaced apart first and second integral gear portions, and said clutch comprises a clutch case connected to the actuator, and an intermediate sleeve axially movable together with the clutch case while being rotatable relative to each other, the intermediate sleeve being axially movable with respect to the second roll member and having a clutch portion which is engaged with one of the gear portions on the screw shaft when the clutch is in the first position, the clutch case having a clutch portion which is engaged with the other gear portion on the screw shaft when the clutch is in the second position.

4. An apparatus according to claim 2, wherein said actuator comprises a fluid cylinder mechanism.

5. An apparatus according to claim 1, further comprising means for obtaining an axially fixed location of the second roll member while the first roll member is axially movable with respect to the second roll member, and actuator means for urging the first roll member along said axis so that contact is maintained between the connection portion and the screw shaft.

6. An apparatus according to claim 5, wherein said actuator means comprise a fluid cylinder.

7. An apparatus according to claim 5, further comprising centering means for obtaining a variable and fixed axial location of the second roll member, so that the roll members are centered at a pass line after an adjustment of a distance between the roll member.

8. An apparatus according to claim 7, wherein said centering means comprise a sleeve member which is rotatable with respect to the second roll member, while being axially movable together with the second roll member, said sleeve member being formed with a screw thread, a fixed member having a screw thread engaging with the sleeve member, and rotating means for imparting a rotating movement to the sleeve member for obtaining the axial movement of the second roll member for said centering.

9. An apparatus according to claim 1, wherein said roll is used in a finish rolling mill in a series of rolling mills for obtaining an H beam.

10. An apparatus according to claim 1, wherein said roll is used in a finish rolling mill in a series of rolling mills for obtaining a channel steel.

* * * * *

UNITED STATES PATENT AND TRADEMARK OFFICE

CERTIFICATE OF CORRECTION

PATENT NO. : 5,152,164

DATED : October 6, 1992

INVENTOR(S) : Yasushi Horiuchi, et al.

It is certified that error appears in the above-identified patent and that said Letters Patent is hereby corrected as shown below:

Column 5, line 35, change "12, and 14," to --12', and 14',--.

Column 6, line 31, "As will" should start a new paragraph.

Column 10, line 5, change "member." to --members.--.

Signed and Sealed this

Ninth Day of November, 1993

*Attest:*

*Attesting Officer*

BRUCE LEHMAN

*Commissioner of Patents and Trademarks*